US006241534B1

(12) United States Patent
Neer et al.

(10) Patent No.: US 6,241,534 B1
(45) Date of Patent: Jun. 5, 2001

(54) GBIC CONNECTOR WITH CIRCUIT BOARD MATING FACES

(75) Inventors: Jay Henry Neer, Boca Raton, FL (US); Munawar Ahmad, Conway, AR (US); Michael J. Miskin; J. Michael Nauman, both of Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/490,526

(22) Filed: Jan. 25, 2000

(51) Int. Cl.[7] ..... H01R 1/00
(52) U.S. Cl. ..... 439/76.1
(58) Field of Search ..... 439/76.1, 638, 439/607, 610, 680, 904, 633, 296–299

(56) References Cited

U.S. PATENT DOCUMENTS

| | | | | |
|---|---|---|---|---|
| 3,364,458 | | 1/1968 | Black et al. . | |
| 4,138,711 | | 2/1979 | Bremenour et al. | 361/424 |
| 4,256,936 | | 3/1981 | Lancaster | 200/51.07 |
| 4,359,257 | * | 11/1982 | Lopinski et al. | 439/405 |
| 5,507,668 | * | 4/1996 | Lambrinos et al. | 439/502 |
| 5,738,538 | | 4/1998 | Bruch et al. | 439/160 |
| 5,757,998 | | 5/1998 | Thatcher et al. | 385/75 |
| 5,767,999 | | 6/1998 | Kayner | 359/163 |
| 5,797,771 | * | 8/1998 | Garside | 439/76.1 |
| 5,879,173 | | 3/1999 | Poplawski et al. | 438/138 |

* cited by examiner

*Primary Examiner*—Tulsidas Patel
(74) *Attorney, Agent, or Firm*—A. A. Tirva

(57) ABSTRACT

A connector interface is provided with a body portion extending between two mating ends and is suitable for providing an interface between a cable and an electronic device. The connector includes a printed circuit board as its terminal and the circuit board extends through the body portion and has first and second mating edges that extend past the body portion of the housing at the mating ends. These mating edges permit the use of edge card technology to simplify the connector assembly and cost. One of the mating edges is enclosed by an extension portion of the connector housing such that the extension defines a receptacle that accommodates an opposing connector, such as a plug end of a cable assembly.

20 Claims, 5 Drawing Sheets

GBIC CONNECTOR WITH CIRCUIT BOARD MATING FACES

BACKGROUND OF THE INVENTION

The present invention relates generally to high speed connectors, and more particularly to connectors for effecting connections between high speed cables and other electronic devices.

There are many receiver and transceiver modules known in the art that are used to provide connectors for transmitting electrical signals between electronic devices and high speed cases. Such transceiver modules may be conventional electronic connectors or they may be utilized in conjunction with an optional data transmission means. Such a module may include a conversion means for converting optical signals to electronic signals or it may include entirely electronic signal conveyance means.

These known modules and connectors typically include an internal circuit board that contains various circuit components. One end of the circuit board may protrude from the connector body while the other end of the circuit board remains inside of the connector body. Leads are terminated to the circuit board at one end and the other ends, the leads are terminated to pins, blade or other type of terminals. These terminations require manual labor and increase the cost of the connector. In order to protect the mating interface within the leads terminated, separate shields must be attached to the connector. Thus, such a termination also involves additional elements.

The present invention is directed to an improved connector for high speed transmission applications which is less expensive to produce than the aforementioned prior art connectors and which also overcomes the aforementioned disadvantages.

SUMMARY OF THE INVENTION

Accordingly, it is a general object of the present invention to provide an improved connector interface for high speed transmission applications.

Another object of the present invention is to provide a gigabit interface connector having an improved termination structure at both ends of the connector, the connector having a connector housing, a printed circuit board disposed in the connector housing and having two opposing ends, the circuit board having an extent greater than the length of the connector, the circuit board ends that protrude through the housing so as to present two distinct mating ends of the circuit board for engagement with opposing components.

Still another object of the present invention is to provide an interface adapter for connecting together a high speed cable with an electronic device, wherein the adapter has an elongated housing with two opposing mating ends, a circuit board extending lengthwise through the housing, the circuit board having a length greater than that of the housing, two opposing ends portions of the circuit board protruding through a body portion of the housing to present two circuit card mating portions, one of the ends of the adapter housing extending over one of the circuit board end portions and forming a receptacle for receiving the plug end of a cable, the one circuit board end portion including means for orienting the plug end with respect to the circuit board end portion.

Yet a still further object of the present invention is to provide an improved gigabit interconnection module that uses edge card mating principle and includes a circuit board extending through its connector housing and protruding through its ends to thereby optimize the electrical characteristics of the signals passing through the interconnect, the first edge of the circuit board serving as a blade portion on one end of the interconnect and the second edge of the circuit board being housed within a receptacle formed by an extension of the housing to receive an end of a cable assembly.

It is still another object of the present invention to provide a connector for cable applications having an improved end structure for connection to a cable connector, the connector having a housing that is easily insertable into and removable from a connector slot formed on a circuit board, the connector having a hollow body portion extending lengthwise, a circuit board with a plurality of circuit traces disposed thereon and may contain some passive and/or active components, the circuit board having first and second opposing ends, the first and second ends of the circuit board passing through openings in corresponding first and second ends of the connector body portion and protruding past the endfaces of the connector body portion, at least one of the first and second circuit board ends being at least partially enclosed by an extension of the connector body portion, the extension being adapted for receiving an opposing connector in the form of a jack.

The present invention accomplishes these and other objects with its novel and unique structure. The connectors of the invention may include a housing having an elongated hollow body portion which houses a printed circuit board. In a departure from the structure present in the prior art, the printed circuit board has first and second opposing, mating ends with circuit pads disposed thereon. The ends of the circuit board each include planar portions with edges that preferably run widthwise of the housing. At one end of the connector, a first mating edge of the circuit board projects outwardly from the connector housing to define a male plug, or blade portion, for meeting with a female style connector of another circuit board or electronic device.

At the other end of the connector, a second mating edge of the circuit board also projects outwardly from the connector housing. The connector housing may have, at this end of the connector, an extension portion that may be integrally formed with part of the housing to define a receptacle with an associated outer shell portion, the receptacle being adapted to accommodate the plug end of a high speed cable assembly, such as an HSSDC cable assembly. The housing extension may be tailored to accept and engage a latch member on a jack-style connector terminated to a plug end of the cable. The housing opening is such that the jack-style connector may be easily inserted into engagement with the circuit board mating end, even in a "blind" manner.

In this regard and with respect to another embodiment of the invention, at least one of the circuit board ends may be formed with one or more slots, preferably on both asides of the conductor pattern on the circuit board. These slots serve as guides, or "lead-ins" that facilitate in the alignment and mating of the cable plug end or any other connector plug end. Not only do these slots help orient the opposing connector with respect to the circuit board for blind connections, but they also help to orient the connector with respect to the interior structure of the circuit board mating end.

In another embodiment of the present invention, the extension portion of the housing is integrally formed therewith to simplify and reduce the time necessary for assembly of the connector. This extension portion acts as a shield that substantially encompasses the interface area of the circuit board edge. In a modification of this aspect, a shell may be provided for the second end of the connector which encompasses the entire width of the circuit board edge. The circuit board in this embodiment, is provided with a plurality of slots defining separate and distinct engagement portions of the circuit card edge, each of which will engage a separate cable plug. The slots serve to align each cable plug into position while the shell is likewise formed with a series of slots and channels aligned with the circuit cord engagement portions to accommodate a "gang" of cables.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DETAILED DESCRIPTION OF THE PREFERRED EMBODIMENTS

Figure 1:
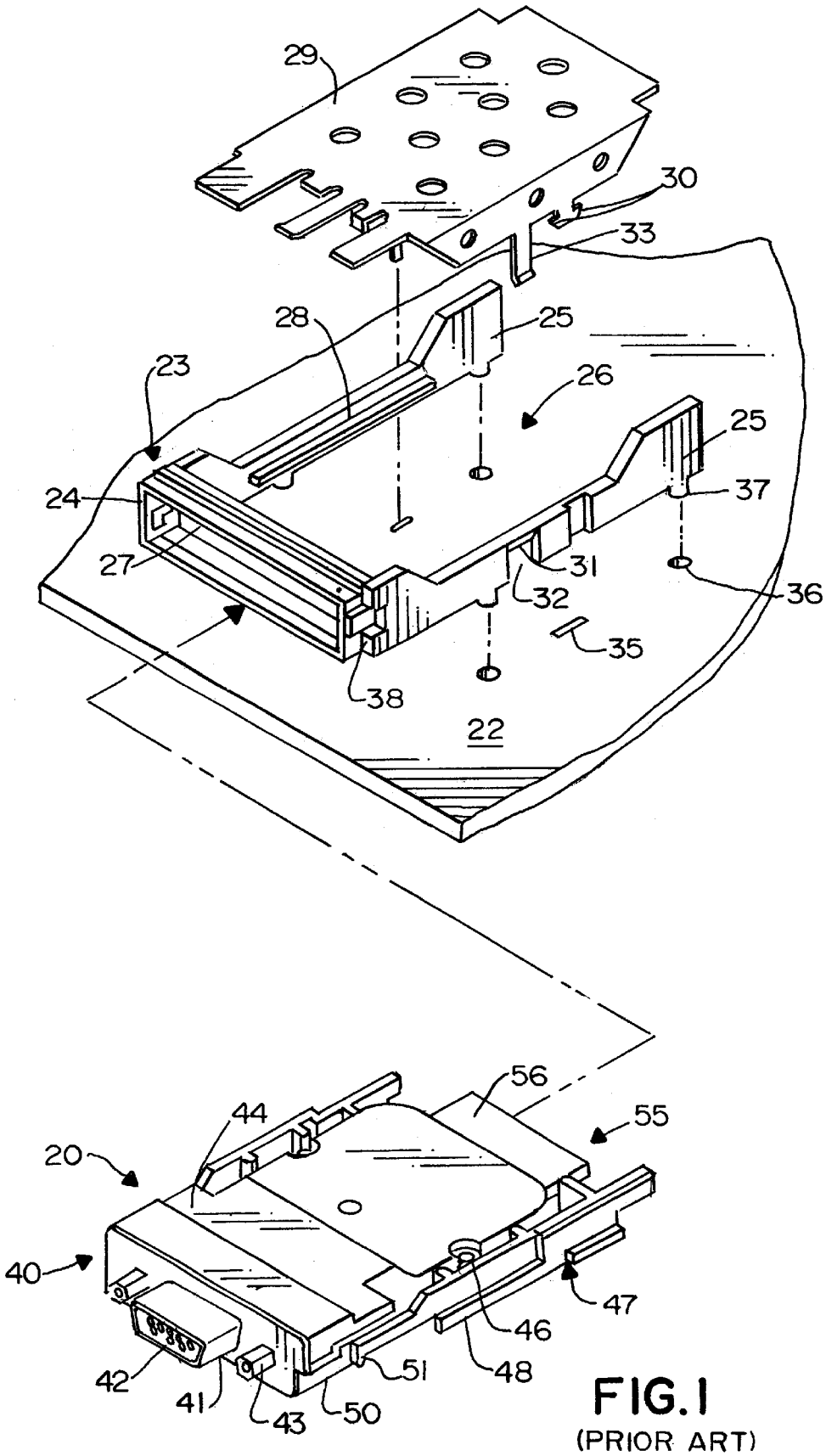
FIG. 1 (PRIOR ART)
FIG. 1 is an exploded perspective view of a GBIC known in the art, illustrating the typical components used to apply the connector to a circuit board.

FIG. 1 illustrates an interface connector, or interconnect 20, of the type that is known in the prior art. The connector 20 is typically used to provide a connection between a cable (not shown) and another connector device (also not shown). The connector 20 may be supported on a circuit board 22 by way of a framework 23 that is itself mounted on the circuit board 22. The framework 23 has a front end 24 with a pair of side rail members 25 extending rearwardly therefrom to define a open space 26 therebetween. The front end 24 of the framework 23 may have a door portion 27 that is capable of pivoting upwardly under the urging of the connector when it is inserted into the framework 23 via its front end 24. The framework 23 may further have, as illustrated, a shielding member 29 that serves as a cover to the framework 23. The shielding member may have side clips 30 that are adapted to engage shoulders 31 formed in slots 32 of the side rail members 25. The shielding member 29 may further include grounding clips 33 that extend down and into corresponding openings 35 formed in the circuit board that are oriented between other openings 36 in the circuit board 22 that receive posts 37 formed on the framework 23.

The connector 20 is constructed so as to be simply inserted into the front end 24 of the connector support framework 23. In this regard, it includes an I/O style front end portion 40 having a shield plate 41 that encompasses a pin connector portion 42. Nuts 43 are used to attached the front end portion 40 to the body portion 44 of the connector 20. The body portion 44 extends rearwardly and may include top and bottom half portions that are held together by screws 46 or other fastening means. A set of retainers 47 extend lengthwise along the sides connector body 44 and include runner portions 48 that engage and slide along like runners 28 formed on the interior surfaces of the framework side rail members 25. The retainers 47 have free ends 50 that extend partly past the front end 40 of the connector 20 with portions 51 that may engage corresponding associated openings 38 in framework 23. These free ends 50 are capable of being grasped by a user and pressed inwardly in order to insert the connector 20 and engage the connector 20 firmly in the support framework 23. Likewise, they may be grasped and pressed to free the retainers 47 from engagement with the openings.

The connector 20 has at its other, or rear end 55, a circuit card edge 56 projecting therefrom. This card edge 56 will typically have leads from the pin connector soldered to it to provide a connection between the circuit card and the pin connector 42 and may contain some active and/or passive components in between. This type of connector requires that the circuit card be terminated to a series of leads (not shown) associated with the pin connector 42. This termination requires extra labor and an inventory of specialized components that are relatively costly to make. Moreover, the pin connector 42 requires a separate shield member to be applied to it and a specially formed opposing pin connector. Still further, the leads of the connector must be soldered to the traces on the circuit card. These solder connections may not always be reliable joints and they can introduce discontinuities and other interference into the signals passing through the connector-circuit board interface.

The present invention is directed to an improved interface connector of much simpler construction and with an integrated means for orienting the opposing connector into alignment and engagement with the front end of the connector. Such a connector is solderless in nature with respect to its connections and is shown generally at 60 in FIG. 2. The connector 60 can be seen to include an elongated housing 62, with opposing end portions 63, 64 interconnected by a body portion 65. The housing 62 may be formed from a nonconductive and preferably insulative material, and further includes an interior hollow portion. The housing may also be formed from a conductive material for shielding purposes. This hollow portion houses a printed circuit board 70 having opposing first and second ends 71, 72 that are exposed at corresponding respective first and second end portions 63, 64 of the connector 60. The connector 60 may include a pair of retainers, shown as elongated retainer arm members 67 that extend lengthwise of the connector body portion 65 and which terminate in free ends 68. The retainer arm members 67 may have lower sliding surfaces formed thereon that ride upon inner runners, such as those shown at 28 in FIG. 1 within a support framework on a circuit board 22. In its most common applications, the interface connector 60 is used to provide a connection between a high speed cable assembly, such as that shown generally at 80 in FIG. 8 and, as an example, a bank of telecommunications termination headers (not shown).

The housing 62 of the connector 60 may be formed from an insulative material such as a plastic and formed conveniently by molding, into two upper and lower half portions 90, 91 that may be fastened together by way of screws 92 or other fasteners. Likewise, the connector housing 62 may be formed as a single hollow member with a rear face 94 having an opening 95 formed therein through which the second edge 72 of the circuit board 70. The retainer free ends 68 may also include textured gripping portions 66 that facilitate a user grasping the retainer members 67 during insertion and removal of the connector 60 from a support member such as the framework 23 of FIG. 1 or other circuit board structure.

The second, or rear end, 64 of the connector 60, is adapted to receive a cable plug or jack-style end 80 of a cable assembly 81. This end 64 is shown best in FIG. 3, wherein it can be seen that the circuit board 70, and especially the second mating end 72 thereof, extends through the body portion 65 of the connector housing 62 to a sufficient extent past the rear face 94 of the housing body portion 65. An opening 95 formed in the housing body portion 65 provides a passage through this second mating end 72 protrudes. A likewise projection of the circuit board first mating end 71 occurs at the first end 63 of the connector 60, where the first mating end 63 extends past the front face 96 of the connector body portion 65. Each end of the connector housing 62 therefore has an associated male "blade" portion associated therewith in the form of a circuit board mating edge 71, 72. Each mating edge 71, 72 is in effect a miniature edge card portion that may be engaged by an opposing connector using edge card engagement technology and resulting in a completely solderless connector 60.

Figure 4:
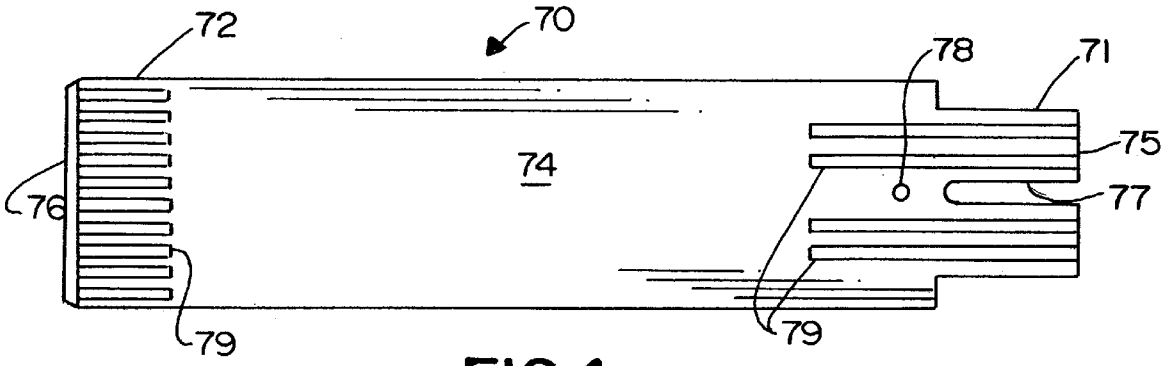
FIG. 4 is a top plan view of a circuit board that is used in the connector of FIG. 2, with mating end portions formed at two opposing ends thereof.

This aspect of the invention is best shown with respect to FIGS. 4–7. In FIG. 4, a circuit board 70 is shown in plan view and has an elongated body portion 74 extending between first and second mating ends 71, 72 thereof. Because the mating ends 71, 72 of the circuit board 70 are "male" parts in terms of connector terminology and will be engaged by opposing connector members that typically have card-receiving slots, the mating ends may have their ultimate edges beveled or chamfered as shown at 75 & 76 in FIGS. 4 & 5. The circuit board may have a conventional layered structure with various copper or other conductive traces and layers applied thereto, including ground plane layers. In most instances, the circuit board 70 will have a plurality of circuit traces or pads 79 and may contain active and/or passive components disposed on its surfaces and in communication with the mating edges 71, 72 thereof, with ten such traces being illustrated at the second edge 72 to the left of FIG. 4 and four such traces shown at the first edge 71 to the right of FIG. 4.

Figure 9:
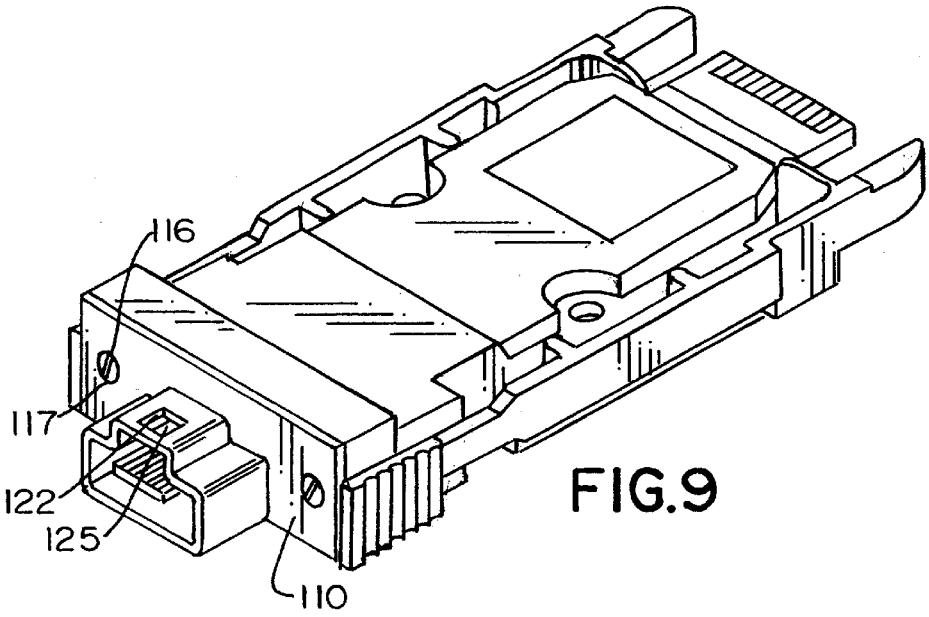
FIG. 9 is a perspective view of a connector constructed in accordance with the principles of the present invention, with a separate end portion adapter applied thereto similar in construction to the adapter used on the circuit board assembly of FIG. 5.

The first mating end 71 of the circuit board 70 may have one or more slots 77 formed therein, and this structure serves two purposes. Firstly, it serves to guide and orient the circuit board 70 within an extension adapter portion 110 that can be applied to the first end 63 of the connector body portion 65, as illustrated in FIG. 9. Secondly, it may serve as a means for polarizing or guiding an opposing connector into the extension portion and into engagement with the mating end 63 of the circuit board 70.

Figure 5:
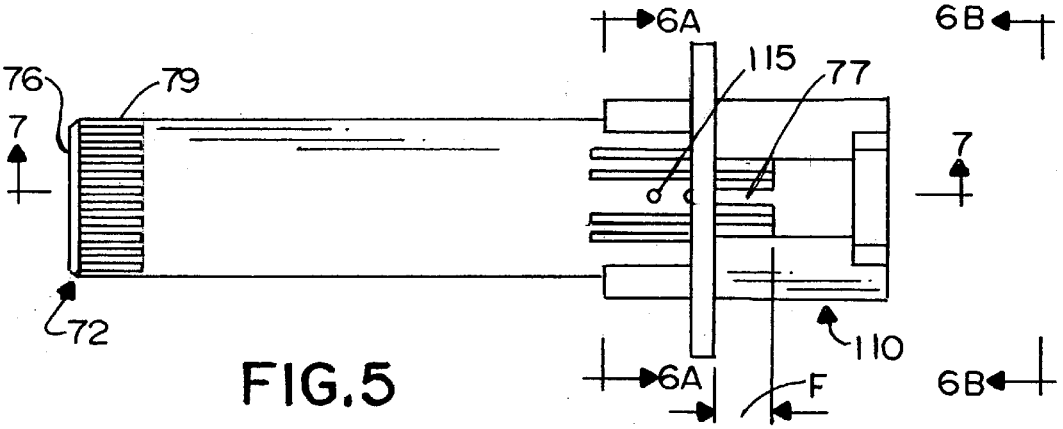
FIG. 5 is a top plan view of the circuit board on FIG. 4 inserted into place within an adapter end used in connectors of the style illustrated in FIG. 9.
Figure 6A:
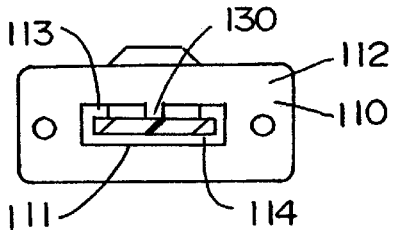
FIG. 6A is sectional view of the circuit board assembly of FIG. 5, taken along lines 6A—6A thereof and illustrating the circuit board held within the end adapter thereof.
Figure 7:
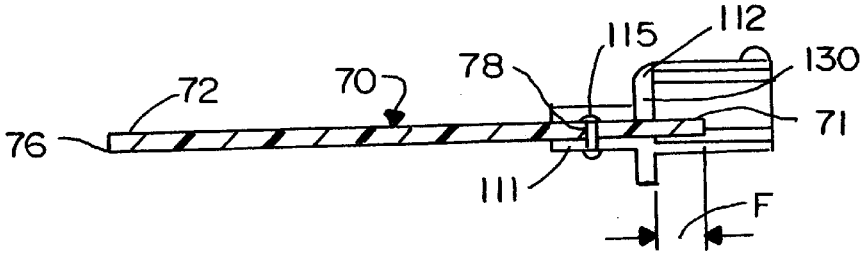
FIG. 7 is a sectional view of the circuit board assembly of FIG. 5, taken lengthwise along lines 7—7 thereof, and illustrating the position of the circuit board with respect to the adapter end.

The extension portion 110 is formed from an insulative material and includes a support base, or bed, 111 that extends for a preselected length therefrom as shown in FIGS. 5–7. In this embodiment, the extension portion 110 takes the form of a separate adapter that is applied to the first end 63 of the connector housing 62. The support bed 111 of the extension receives a portion of the circuit board 70 and in this regard, the support bed 111 extends rearwardly in a general U-shape, as shown best in FIG. 6A, in which a pair of shoulders 113 are spaced apart from the support bed 111 in order to define a horizontal slot 114 for receiving the circuit board 70. The circuit board may have an opening 78 formed therein that can receive a rivet 115, or other fastener so that the circuit board may be fixed in place within the extension portion 110. In this regard, the support base 111 may have a hole 123 formed therein which accommodates the fastener 115. The extension portion 110 further includes a front mating face 96 defined by a plate member 112 that extends generally perpendicular to the support bed 111 and having one or more openings 116 formed therein that receive screws 117 or other fasteners for attachment to the connector body 65 as illustrated in FIG. 9.

Figure 6B:
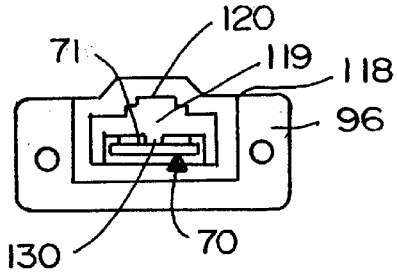
FIG. 6B is an end view of the circuit board assembly of FIG. 5, taken along lines 6B—6B thereof, and illustrating the jack end opening of the adapter end.

The extension portion 110 projects forwardly from the plate member 112 and hence the term "extension". It forms a receptacle end 118 having a hollow interior 119. The extension portion 110 projects a sufficient extent to enclose the circuit board first mating end 71 so that the circuit board end 71 is enclosed within the receptacle end 118 and, as illustrated in FIG. 6B, is spaced apart from the circuit board mating end 71 on all four sides thereof. This will permit insertion of a plug end or jack-style connector 80 into the receptacle end 118. The hollow interior portion 119 may be specially configured, as illustrated in FIG. 6B, in order to receive a plug end orjack-style connector 80 of a corresponding cable assembly 81. The configuration shown in FIG. 6B includes a trapezoidal passage 120 that communicates with receptacle interior 119. This passage 120 permits easy orientation of the plug end 80 with the end 63 of the connector 60, and also serves as a polarization feature.

Figure 8:
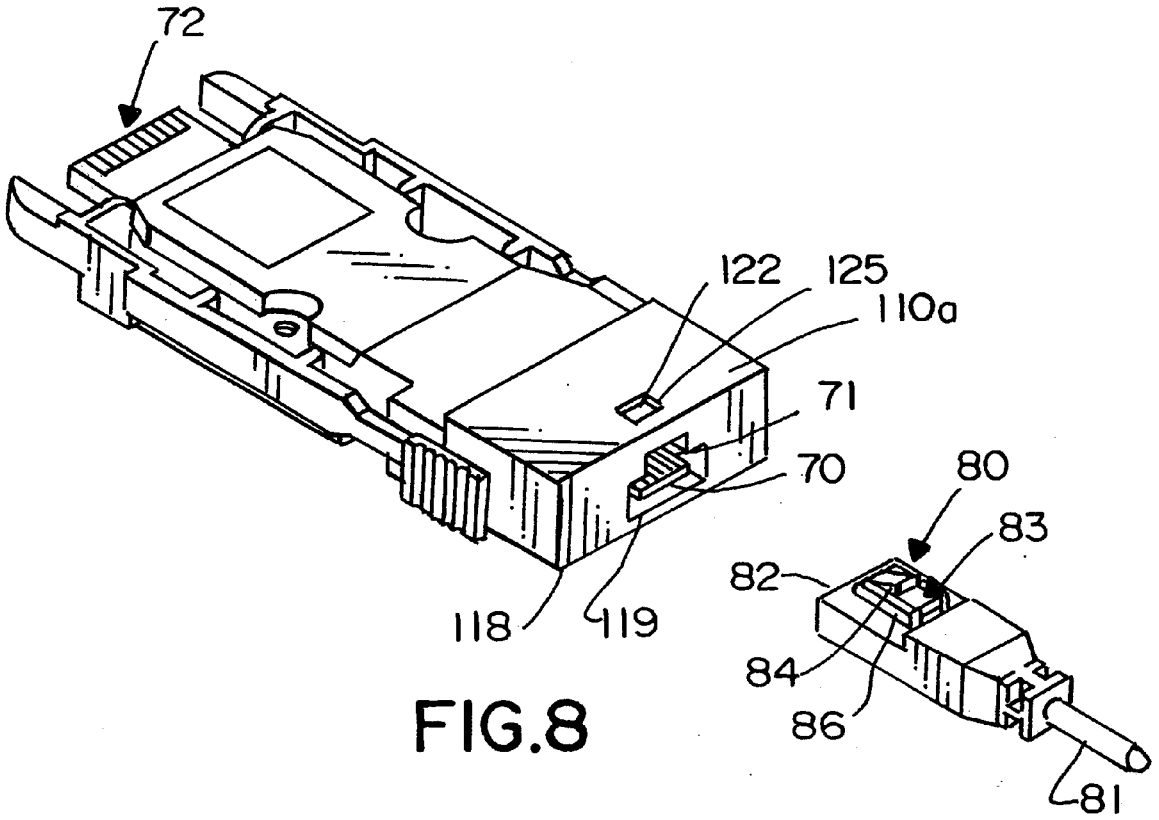
FIG. 8 is a perspective view of another embodiment of an interface connector constructed in accordance with the principles of the present invention with an end portion formed integrally as part of the body portion of the connector housing and with a cable connector end in opposition thereto.

As shown best in FIG. 8, the plug end or jack-style connector 80 of the cable assembly 81 will typically have an engagement face 82 that opposes the receptacle of the interface connector 60. A circuit card or edge card slot (not shown) is disposed in this engagement face 82 such that it is aligned with the circuit board first mating end 71 of the connector 60. The plug end connector 80 may have a latch member 83 associated therewith for retaining the plug end connector 80 in place and in engagement with the connector and such a latch member is preferably formed on the exterior of the housing thereof. This latch member 83 includes, as shown, a manipulatable engagement head 84 that projects upwardly from the connector 80 and which may be formed in a cantilevered fashion so as to be easily depressible and to spring upwardly when the depressing force is released. When the plug end 80 is inserted into the connector 60, the engagement head 84 is received within a latch opening 122 formed in the extension portion 110*a* of the embodiment of FIG. 8, which is an extension portion that may be formed integral with the housing 62, and thereby formed with one of the upper and lower portions 90, 91 of the connector body portion so that access may be had to the interior of the connector housing to insert the circuit board 70 into place. This latch opening 122 communicates with the hollow interior portion 119 of the receptacle end 118 so that the engagement head 84 may engage it upon insertion of the plug end 80 into the hollow interior 119 of the receptacle 118. The latch opening 122 may have a surface or edge 125 that faces the connector body portion and provides a stop surface or shoulder to the latch member 83, and specifically a shoulder 86 of the engagement head 84 to contact in an abutting manner.

Returning to FIGS. 4–7, the circuit board 70 may include an orientation slot 77 formed therein. This slot 77 engages a fixed part of the extension portion 110 so as to orient the circuit board first mating end 71 and its mating edges 75 in a particular orientation within the hollow interior 119 of the receptacle end 118. The extension portion 110 is provided, in the embodiment shown, with a post or other similar member 130, that extends upright and generally perpendicular to the support base 111 and/or the plane of the circuit board 70. This post 130 stops the longitudinal movement of the circuit board 70 when it is inserted from the rear of the extension portion 110 into the slot 114 formed with the support base 111. This fixes the forward extent of the circuit board first mating face 71 in the receptacle interior 119. (FIGS. 5 & 7). The slot 114 and the fastener 115, if desired, fix the horizontal orientation of the circuit board first mating face 71 within the receptacle interior 119.

Figure 2:
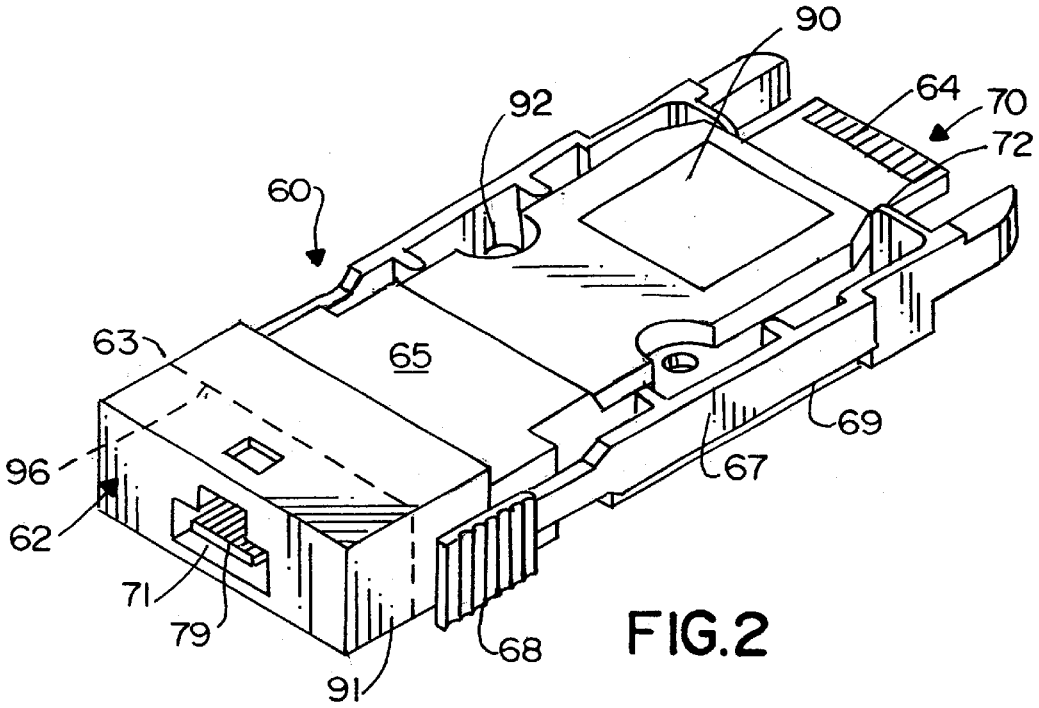
FIG. 2 is a perspective view of one embodiment of an interface connector constructed in accordance with the principles of the present invention.
Figure 3:
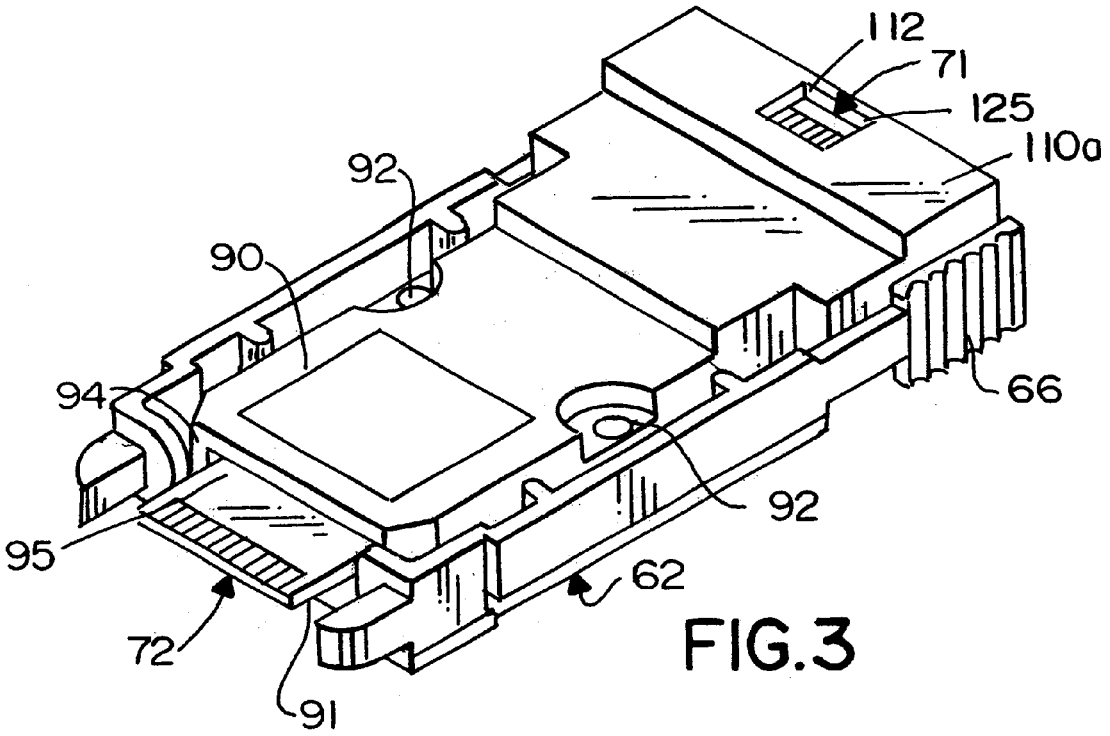
FIG. 3 is a perspective view of the interface connector of FIG. 1, but taken from the other end thereof.
Figure 10:
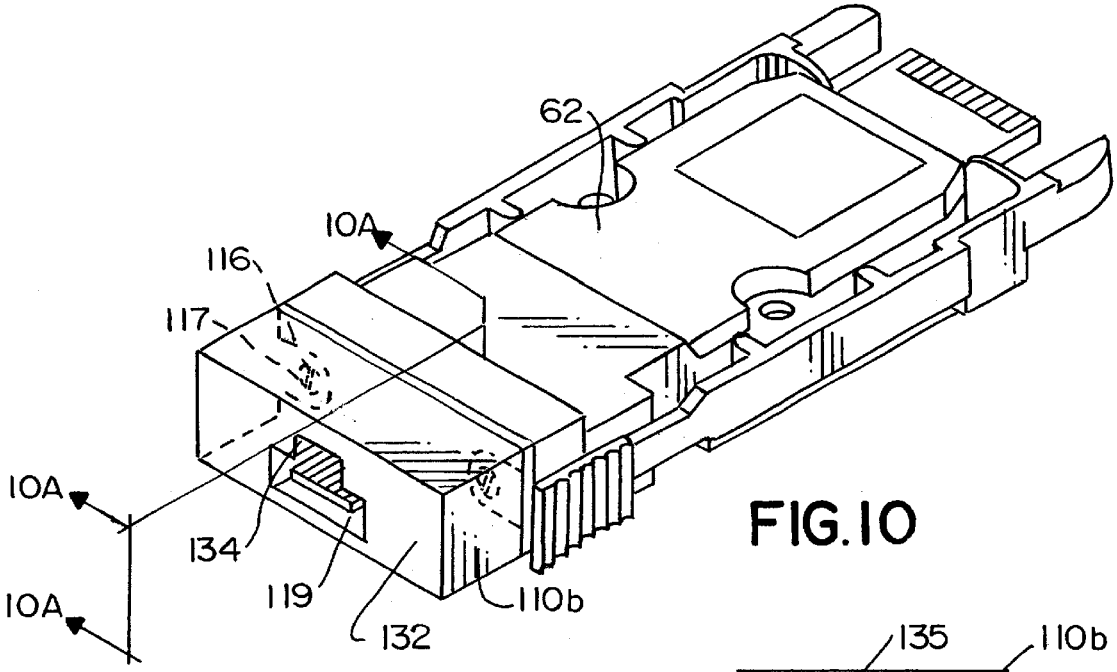
FIG. 10 is a perspective view of another interface connector constructed in accordance with the principles of the present invention and illustrating a separate, drawn shell applied to one end of the connector housing.
Figure 10A:
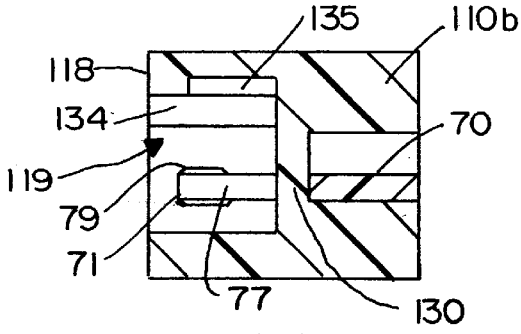
FIG. 10A is a partial sectional view of the extension portion of the first end of the connector of FIG. 10, taken along lines 10A—10A thereof and illustrating the circuit board mating end in place within the receptacle portion of the connector; and, FIG. 11 is a perspective view of a shell attached to a circuit board for providing a number of receptacles corresponding to connection portions formed along an edge of a circuit board.

FIGS. 10 and 10A illustrate an extension portion 110*b* in which the extension portion 110*b* is formed as a solid shell-like member that is attached to the front of the connector housing 62 by screws or the like. This style of extension portion 110*b* has a more flat front face 132 than the adaptor style extension portions of FIGS. 9 & 5 and thus emulates one which is integrated with the connector housing as illustrated in FIGS. 2, 3 & 8. This type of extension 110*b* has a hollow interior 119 formed therein (FIG. 10A) with a polarized configuration of a notch 134 formed in the upper part of the interior 119 that receives the latch 83 of a plug end connector 80. This notch 134 may further include a recess 135 that will engage an engagement head of the latch member.

Figure 11:
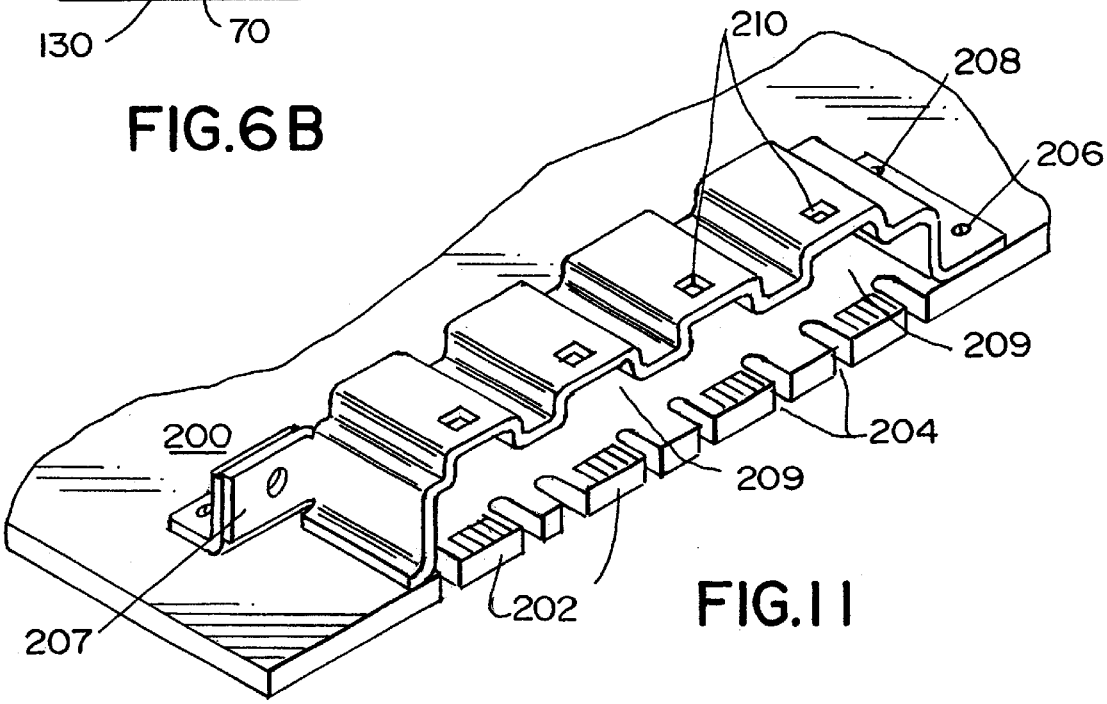

Lastly, FIG. 11 illustrates the application of the structure of the present invention to a circuit board in order to accommodate a plurality of plug or jack-style connectors. In this embodiment, a circuit board 200 has a plurality of engagement ends 202 formed thereon, with each such end 202 being defined by one or more orientation slots 204 formed therein. A shell or extension member 207 is attached to the circuit board via brackets 206 and screws 208. The shell member 206 has a plurality of configured passages 209 formed therein that are adapted to receive latching portions of opposing connectors (now shown) in the manner previously described. Openings 210 in the passages 209 will receive latching members and retain the opposing connectors in place.

It will be appreciated that the present invention provides a solderless connector for use in interface applications. The circuit board extends past both ends of the connector to present two male connector surfaces that may be easily mated with opposing connectors using edge card technology. The elimination of soldered joints decrease the likelihood of signal disruptions and interference. The extension portions of the connectors may be separately die cast from a metal and the integrated extension and connector may also be cast so as to provide an extension portion that will provide enhanced shielding capabilities because it completely surrounds the connection at the circuit board mating edge.

While the preferred embodiments of the invention have been shown and described, it will be appreciated by those skilled in the art that changes and modifications may be made to these embodiments without departing from the spirit of the invention, the scope of which is defined by the appended claims.

What is claimed is:

1. An interface connector for providing a connection between a cable and an electronic device, the connector comprising:

a connector housing having a body portion, the body portion having distinct first and second end portions, the first and second end portions respectively defining first and second engagement ends of said connector;

a circuit board disposed within said housing, the circuit board having first and second ends, with respective first and second mating edges for respectively mating with the cable and the electronic device, said circuit board having a length exceeding a length of said connector housing so that said circuit board first and second mating edges extend out of said housing for a preselected distance at said first and second connector ends, said connector housing further including an extension portion disposed at said housing first end thereof, the extension portion at least partially enclosing said circuit board first mating edge and defining a receptacle at said housing first end that encompasses at least a portion of said circuit board first mating edge, the receptacle being adapted to receive a plug end of said cable; and, a pair of retainer members extending lengthwise along opposite sides of the exterior of said connector housing, said retainer members having free ends disposed thereon proximate to said connector first end, the retainer member free ends being manipulatable by a user to move said free ends thereof into and out of engagement with a supporting framework for said connector.

2. The interface connector of claim 1, wherein said receptacle includes a hollow passage sized to receive said cable plug end, said receptacle further including an engagement opening communicating with said hollow passage and sized to receive a portion of said cable plug end and a latch member of said cable plug end, the engagement opening having an interference surface formed therein which faces away from said housing first end and which is engaged by said latch member.

3. The interface connector of claim 1, wherein said extension portion is integrally formed with said housing.

4. The interface connector of claim 1, wherein said extension portion includes a separately adapter attached to said connector housing.

5. The interface connector of claim 4, wherein said extension portion includes a hollow body portion having first and second faces, the first face being aligned with said circuit board first mating edge so that said circuit board first mating edge does not protrude past said extension portion first face but said circuit board first mating edge is disposed entirely within said connector housing receptacle.

6. The interface connector of claim 1, wherein said circuit board first mating edge has at least one slot formed therein and extending lengthwise of said circuit board for positioning said cable plug end.

7. The interface connector of claim 6, wherein said extension portion has a horizontal slot formed therein that receives said circuit board proximate to said first mating edge thereof and said extension portion further includes a vertical post member that is received within said circuit board first mating edge slot when said circuit board is inserted into said horizontal slot.

8. The interface connector of claim 1, wherein said extension portion includes a metal portion to provide electromagnetic interference shielding to said circuit board first mating edge.

9. The interface connector of claim 1, wherein said circuit board first end has a plurality of slots formed therein extending lengthwise into said circuit board from said first mating edge, the slots defining a plurality of individual mating portions of said circuit board first mating edge and said extension portion at least partially surround said individual mating portions, and further includes a plurality of openings associated therewith, each such opening being dimensional to receive therein an opposing connector therein.

10. An interface connector for providing a connection between two opposing connectors, comprising:

a connector housing having distinct first and second endfaces, a circuit board having first and second mating ends, each of the first and second mating ends including at least one circuit pad thereon, the connector housing having a first preselected length between said first and second endfaces thereof and said circuit board having a second preselected length between said first and second mating ends thereof, said circuit board being housed in said connector housing and said first and second mating ends thereof extending past said connector housing first and second endfaces so that said first and second mating ends may be engaged by opposing connectors, said connector further including an extension portion disposed at said connector housing first end that encompasses said circuit board first mating end, said extension portion including an opening disposed therein, said circuit board first mating end being disposed entirely within said opening such that said opening defines a receptacle in said connector housing first end for receiving an opposing connector therein, said connector housing extension portion further including means for engaging a latch member of the opposing connector, the latch member engaging means being formed as part of said connector housing extension portion.

11. The interface connection of claim 10, wherein said latch member engaging means includes an opening formed with and extending through said extension portion into communication with said receptacle.

12. The interface connection of claim 10, wherein said extension portion is formed integrally with said connector housing.

13. The interface connector of claim 10, wherein said extension portion is separate from said connector housing and is attached to said connector housing along said connector housing first endface.

14. The interface connector of claim 10, further including a separate base member for supporting said circuit board in an orientation within said connector and further including an orienting member for orienting said circuit board in a preselected position with respect to said connector housing first endface within said extension portion opening, and said circuit board includes means for engaging said orienting member.

15. The interface connector of claim 14, wherein said circuit board orienting member engagement means includes at least one slot formed in said circuit board first mating edge and extending lengthwise of said circuit board, and said orienting member includes a post extending generally perpendicular to said circuit board, said post limiting the extent which said circuit board first mating end extends in said connector housing extension portion opening.

16. The interface connector of claim 14, wherein said circuit board first mating end has a beveled mating edge.

17. The interface connector of claim 10, wherein said connector includes a pair of engagement arms extending lengthwise along said connector housing, the engagement arms being adapted to engage a support framework for said connector and further being manipulatable between engagement and non-engagement positions.

18. A connector comprising:

a connector housing having a body portion of a given length, the body portion having opposing first and second ends, said first and second ends including respective first and second openings disposed therein, and a circuit board extending for said body portion length and having respective first and second mating ends that respectively extend through said first and second end openings and project past said first and second ends exterior of said connector housing in preselected first and second extents for mating with first and second opposing connectors, said circuit board having an orientation slot formed therein, the slot engaging an opposing post member disposed within a circuit board orienting member that is itself disposed within connector housing first opening proximate to said connector housing body portion first end, the post member thereby fixing the extent to which said circuit board first mating end projects past said connector body portion first end.

19. The connector as set forth in claim 18, wherein said connector housing includes an extension of said connector housing body portion with a hollow interior passage into which said circuit board first mating end projects, said extension and said hollow interior defining a receptacle for receiving a first opposing connector therein.

20. The connector as set forth in claim 19, wherein said extension includes means for engaging a latch of said first opposing connector.

* * * * *